United States Patent [19]

Herchenroeder et al.

[11] 4,272,289

[45] Jun. 9, 1981

[54] OXIDATION RESISTANT IRON BASE ALLOY ARTICLES FOR WELDING

[75] Inventors: Robert B. H. Herchenroeder; H. Joseph Klein, both of Kokomo, Ind.

[73] Assignee: Cabot Corporation, Kokomo, Ind.

[21] Appl. No.: 98,871

[22] Filed: Nov. 29, 1979

Related U.S. Application Data

[63] Continuation of Ser. No. 672,421, Mar. 31, 1976, abandoned, which is a continuation-in-part of Ser. No. 472,341, May 22, 1974, abandoned.

[51] Int. Cl.[3] ..... C22B 0/00

[52] U.S. Cl. ..... 75/122; 75/124; 75/128 B

[58] Field of Search ..... 75/122, 124, 128 B, 75/171; 148/31

[56] References Cited

U.S. PATENT DOCUMENTS

| | | | |
|---|---|---|---|
| 2,432,615 | 12/1947 | Franks et al. | 75/128 |
| 3,865,581 | 2/1975 | Sekino et al. | 75/122 |

FOREIGN PATENT DOCUMENTS 2162352 6/1972 Fed. Rep. of Germany .

*Primary Examiner*—L. Dewayne Rutledge
*Assistant Examiner*—Upendra Roy
*Attorney, Agent, or Firm*—Jack Schuman; Joseph J. Phillips

[57] ABSTRACT

An improved oxidation resistant iron base alloy article for welding to another article to form a composite product with reduced heat affected zone cracking is provided consisting essentially of about 0.05 to 0.7% carbon, less than 0.3% columbium, about 15 to 30% cobalt, about 18 to 25% chromium, about 0 to 2% manganese, about 1 to 6% molybdenum, about 0.10 to 0.30% nitrogen, about 15 to 30% nickel, about 0.2 to 0.6% silicon, about 0.1 to 2% tantalum, about 1 to 10% tungsten, about 0 to 0.1% zirconium, about 0 to 0.5% aluminum, about 0 to 0.1% lanthanum and the balance iron >23 w/o with incidental impurities not exceeding 0.6% in aggregate. The combined % of columbium and tantalum being at least 0.4% and the combined carbon and nitrogen being >0.2%.

25 Claims, No Drawings

OXIDATION RESISTANT IRON BASE ALLOY ARTICLES FOR WELDING

This application is a continuation of our copending application Ser. No. 672,421, filed Mar. 31, 1976, abandoned which in turn is a continuation-in-part of our co-pending application Ser. No. 472,341, filed May 22, 1974, now abandoned.

This invention relates to oxidation resistant iron base alloy articles for welding and particularly to such alloy articles for welding to another article to form a composite product having reduced heat affected zone cracking.

We have discovered that columbium in excess of a critical small amount, hereafter described, is deleterious to high oxidation resistance in the iron base alloy articles of this invention, that tantalum within certain limits promotes high temperature static oxidation resistance, that carbon and nitrogen are interrelated in their effect on mechanical properties, that a minimum aluminum content is necessary to assure optimum oxidation resistance, that a small but effective amount of zirconium markedly improves thermal fatigue resistance and that the control of these elements in conjunction with one another produces unique and highly desirable properties in iron base alloys.

This invention is related to and is an improvement upon application Ser. No. 99,738, filed Dec. 21, 1970. In co-pending application Ser. No. 99,738, an alloy with improved weldability and oxidation resistance is disclosed. It has now been determined that a particularly useful and novel alloy can be provided through the careful control and regulation of the elements Cb, Ta, Al, C and N, and Zr in a similar composition.

In the continuing search for high performance materials which will withstand adverse environmental conditions such as high temperature and oxidizing atmosphere, the aspect of cost has become increasingly important.

Costs have been accented because significant portions to the total production of many high performance alloys, often called superalloys, are reduced to scrap during the manufacture of the complex designed parts in which these alloys are commonly used.

Far too often these scraps of intrinsically valuable materials, are mixed and become nearly useless because the overall composition of the scraps do not permit recycling of the scraps into melts of the parent alloys.

As a consequence, these scraps are often sold at a small fraction of their intrinsic value to foreign concerns. This contributes adversely to our nation's balance of payments and to our nation's economic well being.

It is a purpose of this invention to provide a superior high performance alloy article which can be produced at relatively low cost because of the utilization of large quantities of mixed alloy scraps and which can be welded with reduced heat affected zone cracking.

In the broadest concept the alloy article consists essentially in weight percent of: 0.05–0.7 C; <0.3 Cb; 15–30 Co; 18–25 Cr; 0–2 Mn; 1.0–6 Mo; 0.10–0.30 N; 15–30 Ni; 0.2–0.8 Si; 0.1–2 Ta; 1–10 W; 0–0.1 Zr; 0–0.5 Al; 0–0.1 La; balance >23 Fe plus incidental elements such as B, Ti, Mg, Cu, S, P, V, Ca which should not exceed about 0.6 weight percent in the aggregate. The Cb and Ta should be 0.4 minimum and the C and N should be >0.2.

A narrower preferred range of composition consists essentially in weight percent of:

Al—0–0.5
C—0.05–0.16
Cb—<0.20
Co—15–25
Cr—18–25
Mn—0–2
Mo—2–5
N—0.10–0.25
Ni—15–25
Si—0.2–0.5
Ta—0.3–2
W—1–8
Zr—0–0.1
La—0–0.1
Balance >23 Fe plus incidental elements such as B, Ti, Mg, Cu, S, P, V, Ca which should not exceed about 0.6% in the aggregate. The Cb and Ta should be >0.4 and the C and N should be >0.2.

A more preferred embodiment consists essentially in weight percent of:

Al—0.1–0.5
C—0.05–0.16
Cb—<0.2
Co—15–25
Cr—19–25
Mn—0.5–2.0
Mo—2–5
N—0.10–0.25
C+N—>0.25
Ni—15–25
Si—0.2–0.5
Ta—0.4–2
W—1–8
Zr—0.001–0.1
La—0.001–0.1
Balance >23 Fe plus incidental elements such as B, Ti, Mg, Cu, S, P, V, Ca and the like which should be <0.6% in the aggregate.

In the period between 1946 and 1951 a series of United States patents including U.S. Pat. Nos. 2,432,614; 2,432,615; 2,432,616; 2,432,617; 2,432,618; 2,432,619; 2,513,467; 2,513,468; 2,513,469; 2,513,470; 2,513,471 and 2,513,472 were issued to Franks and Binder which describe in a broad sense a complex iron base alloy system. An alloy, Multimet* (sometimes referred to as N-155) based upon Franks and Binder's disclosure has been marketed for more than twenty years and is currently covered by Aeronautical Material Specifications 5532B, 5376B, 5768E, 5769, 5794A and 5795B and Mil-E-17496B.

*Registered trademark of Cabot Corporation

Franks and Binder in these patents consistently treated columbium and tantalum as total equivalents and frequently treated columbium and tantalum as equivalents of titanium and vanadium—probably because all of these elements form relatively stable carbides. There was no hint that Franks and Binder even considered the possibility that exclusion of columbium, vanadium and titanium except as tramp residuals, and the predominant use of tantalum rather than columbium would yield a markedly superior alloy. We have found particularly that, while columbium is an effective strengthening element, the presence of Cb in excess of about 0.3 w/o significantly reduces the oxidation resistance of this alloy. However, since scrap generally carries Cb and it is costly to remove, we can tolerate up to 0.3% but prefer that it be totally absent where economically possible.

P. M. Winslow and R. A. Craun ("Cb+Ta N-155" Solar Aircraft Company, Metallurgical Report M6-12-50) did investigate the partial substitution of tantalum for columbium in the N-155 composition, but it appears that they did so to determine if tantalum could be "tolerated" as an impurity so that an impure source of columbium could be used in the manufacture of alloy N-155, i.e. FeCbTa which has a Cb to Ta ratio of about 10 to 1. Winslow-Craun concluded that some Ta could be tolerated but again there was no hint that the exclusion of Cb and use of Ta in the alloy was highly beneficial.

The very fact that Multimet (N-155) has been used for twenty years and has been described by AMS 5532B, which specifies simply that columbium plus tantalum must be present within the range of 0.75–1.25% (no differentiation at all or suggestion of proportions) proves conclusively that those who have used the alloy and those who have made the alloy considered the two elements equivalent on a weight percent basis in effectiveness in the alloy. Because of the relative abundance of Cb compared to Ta, columbium content of the commercial products generally exceeded substantially tantalum content. This indicates columbium has been the preferred element of the two.

In those patents to Franks and Binder where aluminum is discussed a minimum level of 0.5% in the absence of boron is required. Apparently, boron and aluminum were considered substitutional. In the alloy of this invention, Al and B are not interchangeable and >0.5% Al is considered excessive.

Franks and Binder consistently included both carbon and nitrogen in their specifications. Nitrogen was usually referred to as "importantly beneficial", or as an aid to high temperature stability. No data or evidence was presented which would indicate how, or in what manner, nitrogen was beneficial, what aspect of high temperature stability was affected by nitrogen, or that there is an interrelation between carbon and nitrogen and a critical combined amount of nitrogen plus carbon necessary with regard to tensile properties, stress rupture properties, thermal fatigue resistance and weldability. In short, Franks and Binder added nothing to the available knowledge regarding nitrogen, carbon and their effects upon alloys of the type discussed.

Finally, Franks and Binder do not mention zirconium and the beneficial effects of it on the thermal fatigue resistance of the alloy system being discussed.

Wlodek (U.S. Pat. Nos. 3,383,206; 3,304,176 and 3,304,177) discusses a nickel base alloy which contained lanthanum to improve oxidation resistance, but his system was totally different than the alloy of this invention. For example, Wlodek's alloy contained by weight percent 20 Fe max, 6 Co+Mn maximum, 8 Mo minimum and a preferred lanthanum content of 0.17, no requirements of Al, Ta, Cb or zirconium. The alloy of this invention contains 23 Fe minimum, 15 Co minimum, 6 Mo maximum and requirements on Al, Ta, Cb and zirconium.

Wlodek in U.S. Pat. No. 3,304,176 specifically shows that cerium and lanthanum are not interchangeable.

Hessenbruch (U.S. Pat. Nos. 2,075,718; 2,104,836 and 2,067,569) speaks of cerium and misch metal additions to alloys for heating elements. Hessenbruch's alloys are totally different than the alloy of this invention. Hessenbruch used principally Ce not lanthanum, the base composition differed and he did not claim criticality for Cb, Ta, Al, C and N or zirconium.

Thus it is shown that none of the known prior art describes this invention either in composition or concept.

It is believed that a minimum of about 36% nickel plus cobalt is desired to obtain the optimum in oxidation resistance as is 18% Cr—at the lowest possible cost.

The higher levels of Cr, Ni and Co are employed to achieve the better oxidation resistance especially at higher temperatures.

Manganese is an effective spinel constituent and therefore is included in the preferred embodiments within the range of 0.5 to 2.0%.

Both Mo and W are incorporated in the alloy as solid solution strengtheners and carbide formers to provide needed strength, but the maximum Mo which can be tolerated is less than that of W because with its lower atomic weight for a given weight percentage it raises the average electron vacancy concentration ($N_v$) of the alloy and promotes the formation of undesirable topologically close packed phases which normally cause embrittlement. W is undesirable above 10% because of its high density, cost and degradation of oxidation resistance at very high temperatures.

Silicon as noted in our co-pending application Ser. No. 99,738 is necessary at a minimum level of 0.2% to obtain the optimum oxidation resistance. At levels greater than about 0.5% silicon tends to promote intergranular oxidation attack and is also detrimental with respect to metallurgical stability.

Chemical analyses of zirconium at the levels noted in this application are probably no more accurate than ±0.005 weight percent. Hence, the prescribed Zr range of 0.001–0.1 percent is admittedly somewhat ambiguous but the effects of zirconium as noted are real. Zirconium above about 0.1% is not desired in most products because it tends to widen the liquidus-solidus range of the alloy.

A minimum carbon level of about 0.05% is needed if adequate strength is to be obtained.

In wrought products the level of carbon should be less than 0.16 and preferably less than 0.15% if adequate post aged ductility is to be maintained. However, if the alloy is to be cast carbon content can be as high as about 0.7%.

The effects of La have been well demonstrated both in our co-pending application and in this specification. However, it has been demonstrated by these examples that an alloy without lanthanum far superior to the closest current commercial alloy has been discovered. Therefore in the broadest embodiment of this invention, lanthanum can be considered as optional. To achieve the optimum in properties lanthanum must be present in a small but effective amount as noted.

Lanthanum when used may be added in a variety of forms such as alloyed with Ni, Co, Si or other elements or even in an impure form in conjunction with other "rare earths" such as cerium for economic purposes. However, the lanthanum content of the addition mixture should substantially exceed the total of the other rare earths present. Lanthanum, cerium and the other rare earths are not equivalent as noted by Wlodek and others. Excess quantities contribute to "dirt" in the alloy, poor hot workability and poor weldability.

Other incidental elements such as those noted are frequently present in alloys of this type either as intentional additions, for example B to achieve higher moderate-temperature strength, or simply because they are tramp elements in the raw materials and scrap used to fomulate the alloy. In this invention, these elements are preferably maintained at a level less than 0.6% in the aggregate.

The superior quality and unpredicted characteristics of the invention can perhaps best be understood by reference to the following examples.

Chemical analyses of the alloys used to define this invention are listed in Table I.

TABLE I

| | Alloy | Al | B | C | Cb | Co | Cr | Fe | La | Mn | Mo | N | Ni | P | S | Si | Ta | W | Zr |
|---|---|---|---|---|---|---|---|---|---|---|---|---|---|---|---|---|---|---|---|
| A | 147 | 0.03 | <0.001 | 0.01 | <0.02 | 18.60 | 21.50 | 30.71 | 0.010 | 1.10 | 3.18 | 0.13 | 19.30 | 0.006 | 0.005 | 0.23 | 0.45 | 2.38 | <0.01 |
| B | 148 | 0.07 | <0.001 | 0.08 | <0.02 | 18.60 | 21.60 | 30.37 | 0.015 | 1.48 | 3.20 | 0.13 | 19.40 | — | — | 0.32 | 0.45 | 2.46 | <0.01 |
| C | 149 | 0.16 | <0.001 | 0.19 | <0.02 | 18.60 | 21.50 | 30.36 | 0.015 | 1.20 | 3.22 | 0.18 | 19.30 | — | — | 0.29 | 0.49 | 2.52 | <0.01 |
| D | 150 | 0.07 | <0.011 | 0.11 | <0.02 | 19.90 | 21.70 | 28.30 | 0.010 | 1.28 | 3.14 | 0.17 | 20.90 | — | — | 0.28 | 0.51 | 2.50 | <0.01 |
| E | 104 | 0.04 | 0.003 | 0.17 | <0.01 | 20.10 | 21.80 | 28.59 | 0.01 | 1.64 | 3.18 | 0.09 | 19.60 | — | — | 0.36 | 0.48 | 2.38 | 0.01 |
| F | 151 | 0.06 | <0.001 | 0.12 | <0.02 | 20.30 | 21.50 | 27.64 | 0.010 | 1.34 | 3.14 | 0.14 | 21.30 | — | — | 0.26 | 0.60 | 2.50 | <0.01 |
| G | 152 | 0.11 | <0.001 | 0.12 | <0.02 | 20.30 | 21.50 | 27.73 | 0.015 | 1.32 | 3.14 | 0.22 | 21.20 | 0.010 | 0.014 | 0.32 | 0.62 | 2.40 | 0.01 |
| H | 153 | 0.09 | <0.001 | 0.15 | 0.94 | 19.90 | 21.20 | 29.04 | 0.020 | 1.42 | 3.02 | 0.16 | 20.40 | — | — | 0.41 | 0.09 | 2.32 | 0.01 |
| I | 154 | 0.08 | <0.01 | 0.14 | 0.92 | 19.60 | 21.70 | 28.88 | 0.011 | 1.50 | 3.02 | 0.18 | 20.00 | — | — | 0.42 | 0.08 | 2.34 | — |
| J | 136 | 0.12 | — | 0.13 | 1.06 | 19.20 | 21.20 | 29.45 | 0.02 | 1.44 | 3.10 | 0.12 | 19.90 | — | — | 0.40 | — | 2.46 | 0.04 |
| K | 143 | 0.06 | — | 0.12 | 1.04 | 19.40 | 21.50 | 29.33 | 0.01 | 1.56 | 3.04 | 0.12 | 19.90 | — | — | 0.32 | — | 2.30 | 0.02 |
| L | 137 | 0.23 | — | 0.11 | — | 19.75 | 21.40 | 30.97 | — | 1.54 | 3.10 | — | 19.90 | 0.007 | 0.011 | 0.28 | — | 2.48 | — |
| M | 138 | 0.18 | — | 0.12 | 0.24 | 19.70 | 21.20 | 30.93 | — | 1.52 | 3.10 | — | 19.80 | — | — | 0.29 | — | 2.48 | — |
| N | 139 | 0.24 | — | 0.1 | 0.70 | 19.60 | 20.85 | 30.99 | — | 1.45 | 3.08 | — | 19.80 | — | — | 0.21 | — | 2.50 | — |
| O | 140 | 0.07 | — | 0.14 | 0.24 | 19.10 | 20.60 | 29.44 | — | 1.48 | 2.98 | 0.16 | 19.70 | — | — | 0.29 | 1.02 | 2.44 | 0.04 |
| P | 141 | 0.03 | — | 0.14 | 0.40 | 19.20 | 20.50 | 29.38 | — | 1.50 | 2.94 | 0.15 | 19.90 | — | — | 0.29 | 1.01 | 2.50 | 0.02 |
| Q | 142 | <.01 | — | 0.14 | 0.60 | 19.20 | 20.40 | 29.42 | — | 1.48 | 2.92 | 0.15 | 19.80 | — | — | 0.30 | 0.90 | 2.54 | 0.02 |
| R | 144 | .18 | — | 0.12 | 0.18 | 19.20 | 20.40 | 29.35 | 0.046 | 1.54 | 2.94 | 0.07 | 20.00 | — | — | 0.40 | 1.25 | 2.22 | 0.06 |
| S | 145 | 0.14 | — | 0.12 | 0.30 | 19.20 | 20.30 | 29.43 | 0.038 | 1.50 | 2.94 | 0.08 | 19.90 | — | — | 0.38 | 1.30 | 2.24 | 0.04 |
| T | 146 | 0.16 | — | 0.11 | 0.26 | 19.20 | 20.30 | 29.26 | 0.058 | 1.52 | 2.94 | 0.07 | 19.90 | — | — | 0.40 | 1.30 | 2.22 | 0.04 |

All of the alloys were initially induction-melted in air in nominally 70-lb. heats using commercial grade raw materials.

Alloys A through K were cast into 3-inch diameter electrodes and subsequently electro-slag remelted.

Alloys L through T were not remelted but were melted in groups of three. Nominally, 70-lb. heats of the base alloys L, O and R were melted.

After casting the first 20-lb. ingot, a late addition of columbium was made to form alloy M which was cast, and an additional late addition of columbium was made to form alloy N.

In similar manner, alloys P and Q were produced by adding columbium to the base melt of alloy O, and alloys S and T were produced by adding columbium to the base melt of alloy R. In the case of alloys R, S and T, individual late additions of lanthanum were also made.

Alloys A through I were processed simultaneously as were alloys L through T and alloys J and K. Forging temperatures were 2050°–2150° F.; hot rolling temperature was 2050° F. Portions of the alloys were annealed at 2050° F. and portions at 2150° F. to evaluate this variable. Alloys A through I were cold rolled 20% to improve surface finish and reannealed; alloys J through T were tested in the as hot rolled, annealed and pickled condition.

All of the alloys had excellent hot and cold workability. Alloy U was a randomly chosen heat of commercially produced material which met the requirements of AMS 5532B. The procedure for dynamic oxidation tests was as follows:

1. Prepare specimens about $1/16 \times \frac{3}{8} \times 3$ inches.
2. Grind all surfaces to a 120 grit finish and degrease in a solvent such as acetone.
3. Measure exact surface area and weight of each specimen.
4. Expose specimens in a holder rotating at 30 RPM to the combustion products of an oil fired flame plus excess air moving at a velocity of about 0.3 Mach.
5. Cool to near ambient temperature each 30 minutes.
6. Weigh each sample after every 25-hours of the test for the duration of the tests.
7. Section each sample at a point 2-inches from the base, mount for metallographic examination and optically measure depth of continuous penetration, depth of internal oxidation and unaffected thickness.
8. Calculate average weight loss (mg/cm$^2$).
9. Calculate total depth of affected metal.

The procedure for the static oxidation resistance tests was as follows:

1. Prepare specimens about $\frac{3}{4}'' \times \frac{3}{4}''$ in size and having a thickness of between 0.03 and 0.25".
2. Grind all surfaces to a 120 grit finish and degrease in acetone.
3. Measure exact surface area and weight of each specimen.
4. Expose specimens to dry air flow of more than 2 cu.ft./hr. per in.$^2$ of furnace cross section through the furnace while maintaining a constant temperature therein for four 25-hour periods with the specimens being air cooled to room temperature after each 25-hour period.
5. Reweigh each specimen.
6. Descale specimens in salt bath.
7. Carefully weigh the descaled specimens and calculate the weight loss of each.
8. Convert these weight loss figures to "average depth of metal lost" values in accordance with the following formula:

$$\frac{\text{Measured Weight Loss}}{\text{Density of Alloy}} \times \frac{1}{\text{Surface Area of Specimen}}$$

Dynamic oxidation data are presented in Table II and static oxidation data are present in Table III.

TABLE II 2,000° F. DYNAMIC OXIDATION DATA (100 hr. test)

| Alloy | | Weight Loss Mg/cm$^2$ |
|---|---|---|
| A | 147 | 27 |
| B | 148 | 16 |
| C | 149 | 5 |
| D | 150 | 15 |
| F | 151 | 21 |

TABLE II-continued

| 2,000° F. DYNAMIC OXIDATION DATA (100 hr. test) | | |
|---|---|---|
| Alloy | | Weight Loss Mg/cm$^2$ |
| G | 152 | 7 |
| H | 153 | 68 |
| I | 154 | 95 |
| U | 5533 | 178 |
| L | 137 | 51 |
| M | 138 | 111 |
| N | 139 | 260 |
| O | 140 | 95 |
| P | 141 | 105 |
| Q | 142 | 208 |
| R | 144 | 10 |
| S | 145 | 30 |
| T | 146 | 15 |
| U | 5533 | 300 |

Test results from alloys A–I and the first value listed for alloy U are averages of 4 determinations from 3 tests.
Test results from alloys L–T and the second value for U are single determinations from a single test.

TABLE III

| 2,000° F. STATIC OXIDATION DATA | | |
|---|---|---|
| Alloy | | Descaled Metal Loss, mils/side |
| A | 147 | 0.45 |
| B | 148 | 0.50 |
| C | 149 | 0.49 |
| D | 150 | 0.42 |
| F | 151 | 0.57 |
| G | 152 | 0.43 |
| H | 153 | 0.77 |
| I | 154 | 0.89 |
| L | 137 | 1.10 |
| M | 138 | 1.40 |
| N | 139 | 2.9 |
| O | 140 | 0.71 |
| P | 141 | 1.00 |
| Q | 142 | 1.40 |
| R | 144 | 0.40 |
| S | 145 | 0.59 |
| T | 146 | 0.44 |
| U | 5533 | 2.12 |

Alloys L, M and N represent a base alloy with increasing columbium content of 0, 0.24 and 0.70 weight percent respectively, but with no tantalum or lanthanum. It is readily apparent that weight loss because of oxidation in a dynamic environment increased as columbium content increased.

Alloys O,P and Q represent a base alloy containing nominally 1 w/o Ta, no lanthanum, and increasing amounts of columbium of 0.24, 0.40 and 0.60 w/o respectively. It is obvious that Cb is very detrimental to the dynamic oxidation resistance of the alloy system.

TABLE IV

| Alloy | Al. Content w/o | DYNAMIC OXIDATION Weight Loss mg/cm$^2$ |
|---|---|---|
| A 147 | 0.03 | 27 |
| F 151 | 0.06 | 21 |
| D 150 | 0.07 | 15 |
| B 148 | 0.07 | 16 |
| G 152 | 0.11 | 7 |
| C 149 | 0.16 | 5 |

Alloys R, S and T represent a base series of alloys containing nominally 1.30 w/o Ta, nominally 0.04–0.06 La and columbium contents of 0.18, 0.30 and 0.26 respectively. Again, the effect of columbium is noted but the effects are dampened by the presence of the small amount of lanthanum.

Alloys A–D, F and G are alloys containing nominally one half percent of Ta, a small but very effective amount of lanthanum and essentially no columbium. The oxidation weight bases of these alloys should be compared first to those of alloys H and I and finally to the weight losses measured for alloy U. The results show conclusively that columbium is extremely detrimental, that tantalum is not and that lanthanum promotes the oxidation resistance of the system.

Two additional effects are to be noted from the data from the severe dynamic oxidation test. First is the effect of a small but effective amount of zirconium, in this case 0.01 w/o, on the oxidation resistance. Alloys H and I are alike with the exception that a small addition of zirconium was added to alloy H just prior to casting; none was added to alloy I. This small amount caused a 27% reduction in oxidation loss.

Secondly, to achieve the optimum in oxidation resistance, aluminum should be present in the alloy. Table IV compares the oxidation resistance of the similar alloys A–D, F and G. The correlation is unmistakable.

Alloy A has excellent dynamic oxidation resistance when compared to the commercial product alloy U, but to optimize this resistance to the fullest extent, the alloy should contain at least about 0.1 Al and a small but effective amount of zirconium.

The effects of columbium, tantalum and zirconium on static oxidation resistance can also be noted in the data of Table III. The beneficial effects of Al noted in the dynamic oxidation tests is not readily apparent.

The marked effect of a very small amount of zirconium was also noted in the thermal fatigue resistance of sheet product. Also, a dramatic effect of carbon plus nitrogen was noted. Alloys A–I, which were annealed at 2150° F. and U were tested as follows:

1. Sheet samples nominally 1/16 inch thick and 3 inch square were prepared by pack grinding the edges of the sheets to be tested so that the resulting grind marks ran parallel to the edges of the sheet and so that the effects of grinding would be uniform.

2. The specimens were mounted on a rotating drum so that in one group the edges of the specimen heated were parallel to the previous rolling direction and in the second test group the edges to be heated were perpendicular to the rolling direction.

3. The drum was then rotated at a speed of about 0.3 RPM so that the edges of the specimens passed through a neutral oxyacetylene flame emanating from a #72 tip size with about a 6" outer cone, causing a semi-circular heated zone on each specimen.

4. The maximum temperature of 1650° F. was monitored by using a fine wire thermocouple attached to a dummy specimen 5. Specimens were evaluated on the basis of thermal cycle for first crack initiation and by total crack length in mils.

The thermal fatigue data are set out in Table V below:

TABLE V

| THERMAL FATIGUE RESISTANCE AT 1650° F. | | | | | |
|---|---|---|---|---|---|
| | Edges Parallel* to Roll Direction | | Edges Perpendicular to Roll Direction*** | | |
| Alloy | Thermal Cycle for Crack Initiation | Total Crack Length Mils. | Thermal Cycle for Crack Initiation | Total Crack Length Mils. | C + N % |
| A 147 | 118 | 192 | 246 | 150 | 0.15 |
| B 148 | 133 | 152 | 322 | 95 | 0.21 |
| C 149 | 250 | 79 | 406 | 73 | 0.37 |

TABLE V-continued

| THERMAL FATIGUE RESISTANCE AT 1650° F. | | | | | |
|---|---|---|---|---|---|
| | Edges Parallel* to Roll Direction | | Edges Perpendicular to Roll Direction*** | | |
| Alloy | Thermal Cycle for Crack Initiation | Total Crack Length Mils. | Thermal Cycle for Crack Initiation | Total Crack Length Mils. | C + N % |
| E 104 | 150 | 201 | 194 | 223 | 0.26 |
| F 151 | 168 | 176 | 220 | 201 | 0.25 |
| G 152 | 245 | 81 | 369 | 95 | 0.33 |
| H 153 | ** | ** | 406 | 77 | 0.31 |
| I 154 | 150 | 219 | 266 | 130 | 0.33 |

*total thermal cycle 250
**no cracks
***total thermal cycles 406

Since alloys A, B and C have essentially the same composition with the exception of carbon plus nitrogen, these alloys can be compared directly. Alloys E, F, and G likewise can be compared in this respect. Furthermore, alloys H and I can be compared. However, the members of each of the three groups should only be compared within the group because alloys A, B and C have less Ni+Co than do alloys E, F and G and alloys H and I contain columbium instead of Ta.

Comparing the data of alloys A, B and C and E, F and G separately, one can readily see the increase in fatigue resistance with the respective increase of C+N content, both in terms of crack initiation and total crack lengths.

The most surprising development of all was the discovery that alloy H had outstanding thermal fatigue resistance compared to its counterpart alloy I. This unexpected improvement is attributed to the small but effective amount of zirconium which was added to alloy H.

Data from stress rupture tests at 1500° F.—18KSI of alloys A through C and E through I are listed in Table VI, and the average life of the specimens versus C, N and C+N are plotted in FIG. 1. For reference, the qualification stress rupture condition of alloys meeting the AMS 5533 B specification is 1500° F.—18KSI—24 hour life. All of these alloys surpass this requirement.

TABLE VI

| Effects of Carbon and Nitrogen On Average Stress Rupture Life at 1500° F.-18KSI | | | |
|---|---|---|---|
| Alloy | Life hrs. | Elongation % | C + N w/o |
| A 147 | 31.3 | 46 | 0.14 |
| B 148 | 76.7 | 61 | 0.21 |
| | 56.6 | 56 | |
| C 149 | 91.1 | 28 | 0.37 |
| | 85.8 | 34 | |
| E 104 | 46.7 | 34 | 0.26 |
| F 151 | 177.3 | 36 | 0.25 |
| G 152 | 111.7 | 39 | 0.33 |
| | 105.8 | 42 | |
| H 153 | 199.8 | 42 | 0.31 |
| | 240.5 | 41 | |
| I 154 | 72.2 | 52 | 0.33 |
| | 128.6 | 46 | |

When the average stress rupture lives of these alloys are plotted versus either C or N there is no apparent correlation. However, when the average lives of the specimens are plotted versus combined C plus N definite trends appear. There is a valid correlation between C plus N content and stress rupture life. Admittedly, two curves are developed but both indicate stress rupture life increases with increased C+N and the desirability of maintaining the level of C+N greater than 0.20 and preferably greater than 0.25 is obvious. The reason for the two curves is not understood at present. Possibly a strengthening precipitate of some sort caused the difference. Electron microscopy did reveal extremely fine precipitates in some of the samples.

Ultimate tensile and 0.2% offset yield strengths at 1200° and 1600° F. show similar correlations. Tensile data from test performed per ASTM standards at RT, 1200° and 1600° F. are listed in Table VII and are plotted in FIGS. 2 through 5 inclusive.

TABLE VII

| TENSILE DATA Annealed Sheet | | | | | |
|---|---|---|---|---|---|
| ALLOY | HEAT | TEMPERATURE °F. | 0.2% OFFSET YS, KSI | ULTIMATE KSI | ELONGATION % |
| A | 147 | | | | |
| 0.02C | | | | | |
| 0.13N | | 1200 | 20.6 | 64.3 | 68 |
| 0.15C + N | | — | 19.6 | 63.8 | 65 |
| | | 1600 | 17.8 | 37.7 | 42 |
| | | — | 18.7 | 37.2 | 43 |
| B | 148 | | | | |
| 0.08C | | | | | |
| 0.13N | | 1200 | 23.4 | 68.6 | 62 |
| 0.21C + N | | — | 24.2 | 72.4 | 66 |
| | | 1600 | 21.8 | 40.0 | 44 |
| | | — | 22.6 | 41.4 | 35 |
| C | 149 | | | | |
| 0.19C | | 1200 | 39.1 | 92.7 | 49 |
| 0.18N | | — | 38.4 | 93.6 | 53 |
| 0.37N + C | | | | | |
| | | 1600 | 27.2 | 44.4 | 36 |
| | | — | 27.7 | 46.4 | 46 |
| E | 104 | | | | |
| 0.17C | | | | | |
| 0.09N | | 1200 | 29.4 | 82.8 | 65 |
| 0.26C + N | | — | 29.4 | 79.1 | 56 |
| | | 1600 | 25.1 | 43.6 | 33 |
| | | — | 21.6 | 40.7 | 36 |
| F | 151 | | | | |
| 0.11C | | 1200 | 28.5 | 78.9 | 69 |
| 0.14N | | — | 28.7 | 78.9 | 69 |
| 0.25C + N | | | | | |
| | | 1600 | 26.3 | 45.3 | 32 |
| | | — | 26.9 | 47.7 | 42 |
| G | 152 | | | | |
| 0.11C | | 1200 | 38.8 | 90.9 | 51 |
| 0.22N | | — | 39.1 | 91.3 | 69 |
| 0.33C + N | | | | | |
| | | 1600 | 30.9 | 48.1 | 40 |
| | | — | 30.7 | 48.1 | 33 |
| H | 153 | | | | |
| 0.15C | | 1200 | 38.2 | 88.4 | 47 |
| 0.16N | | — | 38.0 | 87.0 | 44 |
| 0.31C + N | | | | | |
| | | 1600 | 27.1 | 43.1 | 40 |
| | | — | 24.5 | 42.2 | 34 |
| I | 154 | | | | |
| 0.15C | | | | | |
| 0.18N | | 1200 | 36.6 | 87.7 | 41 |
| 0.33C + N | | — | 37.6 | 89.6 | 45 |
| | | 1600 | 29.3 | 46.3 | 25 |
| | | — | 29.7 | 47.0 | 33 |

As in the case of the stress rupture data, when tensile or yield strengths are plotted versus either C or N no apparent correlation exists. However, when the data are plotted versus C+N combined, very good correlations are established and desirability of controlling the combined total of C and N is apparent. Duplex curves as in the stress rupture data are developed at 1600° F., and again the cause of this is not completely understood; there is undoubtedly another mechanism operative which adds a significant cumulative effect to that of C plus N. The fact that the effect is noted at 1600° F. but not at 1200° F. where only a single curve is developed further suggests a precipitation phenomena. Thus, with proper heat treatments one would anticipate controlling the reaction.

Nitrogen is beneficial in reducing heat affected zone cracking (HAZ), contrary to accepted teaching. It is generally accepted that higher levels of gases will reduce weldability. Tig-a-ma-jig tests were performed on pairs of the alloys with similar carbon contents but varying nitrogen content. Table VIII below illustrates this effect.

TABLE VIII

| Alloy | Weldability Average Total HAZ Crack length, Mils | $N_2$ % | C % |
|---|---|---|---|
| E | 169 | 0.09 | 0.17 |
| C | 83 | 0.18 | 0.19 |
| F | 69 | 0.14 | 0.11 |
| G | 12 | 0.22 | 0.12 |

The data show that for a given carbon content, increased nitrogen reduced HAZ, and that high carbon content promotes HAZ cracking. (Another basis for a carbon limitation of about 0.15% in the preferred embodiment.)

The data presented and the discussion thereof clearly illustrate that an alloy with heretofore unknown or suspected qualities has been discovered.

While we have illustrated and described certain preferred embodiments of our invention, it will be understood that this invention may be otherwise embodied within the scope of the following claims.

We claim:

1. An improved oxidation resistant iron base alloy article for subsequent welding to another article to form a composite product characterized by reduced heat affected zone cracking high oxidation resistance and improved thermal fatigue resistance as compared with columbium and vanadium bearing iron base alloys consisting essentially of about 0.05 to 0.7% carbon, less than 0.3% columbium, about 15 to 30% cobalt, about 18 to 25% chromium, about 0 to 2% manganese, about 1 to 6% molybdenum, about 0.10 to 0.30% nitrogen, about 15 to 30% nickel, about 0.2 to 0.8% silicon, about 0.1 to 2% tantalum, about 1 to 10% tungsten, about 0 to 0.1% zirconium, about 0.1 to 0.5% aluminum, about 0.001 to 0.1% lanthanum and the balance >23% iron with incidental impurities aggregating less than about 0.6%.

2. The alloy article of claim 1 wherein the zirconium content is in the range 0.001 to 0.1%.

3. The alloy article of claim 1 wherein the manganese content is in the range 0.5 to 2%.

4. The alloy article of claim 1 wherein the aluminum content is in the range 0.1 to 0.5%.

5. The alloy article of claim 1 having 0.001 to 0.3% zirconium, 0.5 to 2% manganese, 0.001 to 0.1% lanthanum, and 0.1 to 0.5% aluminum.

6. An improved oxidation resistant iron base alloy article for welding to another article to form a composite product characterized by reduced heat affected zone cracking high oxidation resistance and improved thermal fatigue resistance as compared with columbium and vanadium bearing iron base alloys consisting essentially of about 0.1 to 0.5% aluminum, about 0.05 to 0.16% carbon, less than 0.20% columbium, about 15 to 25% cobalt, about 18 to 25% chromium, about 0 to 2% manganese, about 2 to 5% molybdenum, about 0.10 to 0.25% nitrogen, about 15 to 25% nickel, about 0.2 to 0.5% silicon, about 0.3 to 2% tantalum, about 1 to 8% tungsten, about 0 to 0.1% zirconium, about 0.001 to 0.1% lanthanum and the balance >23% w/o iron with incidental impurities aggregating less than about 0.6%.

7. The alloy article of claim 6 having about 0.1 to 0.5% aluminum, about 0.5 to 2% manganese, and about 0.001 to 0.1% zirconium.

8. The alloy article of claim 6 wherein the aggregate % of carbon plus nitrogen >0.2.

9. The alloy article of claim 7 wherein the aggregate % of carbon plus nitrogen >0.25.

10. An improved oxidation resistant iron base alloy article for welding to another article to form a composite product characterized by reduced heat affected zone cracking high oxidation resistance and improved thermal fatigue resistance as compared with columbium and vanadium bearing iron base alloys consisting essentially of about 0.1 to 0.5% aluminum, about 0.05 to 0.16% carbon, less than 0.2% columbium, about 15 to 25% cobalt, about 19 to 25% chromium, about 0.5 to 2.0% manganese, about 0.10 to 0.25% nitrogen, about 15 to 25% nickel, about 2 to 5% molybdenum, about 0.2 to 0.15% silicon, about 0.4 to 2% tantalum, about 1 to 8% tungsten, about 0.001 to 0.1% zirconium, about 0.001 to 0.1% lanthanum and the balance >23% iron with incidental impurities aggregating less than about 0.6% and wherein the aggregate % of carbon plus nitrogen is >0.2.

11. The alloy article of claim 10 having about 1 to 4% tungsten and columbium >0.1%.

12. The alloy article of claim 10 wherein the aggregate columbium and tantalum content is at least 0.4%.

13. The alloy article of claim 11 wherein the aggregate columbium and tantalum content is at least 0.4%.

14. The alloy article of claim 10 wherein the aggregate % of carbon plus nitrogen is >0.25.

15. An improved oxidation resistant iron base alloy consisting essentially of about 0.05 to 0.7% carbon, less than 0.3% columbium, about 15 to 30% cobalt, about 18 to 25% chromium, about 0 to 2% manganese, about 1 to 6% molybdenum, about 0.10 to 0.30% nitrogen, about 15 to 30% nickel, about 0.2 to 0.8% silicon, about 0.1 to 2% tantalum, about 1 to 10% tungsten, about 0 to 0.1% zirconium about 0.1 to 0.5% aluminum, about 0.001% to 0.1% lanthanum and the balance >23% iron with incidental impurities aggregating less than about 0.6%.

16. The alloy of claim 15 wherein the zirconium content is in the range 0.001 to 0.1%.

17. The alloy of claim 15 wherein the manganese content is in the range 0.5 to 2%.

18. The alloy of claim 15 having 0.001 to 0.1% zirconium, 0.5 to 2% manganese, 0.001 to 0.1% lanthanum and 0.1 to 0.5% aluminum.

19. An improved oxidation resistant iron base alloy consisting essentially of about 0.1 to 0.5% aluminum, about 0.05 to 0.16% carbon, less than 0.20% columbium, about 15 to 25% cobalt, about 18 to 25% chromium, about 0 to 2% manganese, about 2 to 5% molybdenum, about 0.10 to 0.25% nitrogen, about 15 to 25% nickel, about 0.2 to 0.5% silicon, about 0.3 to 2% tantalum, about 1 to 8% tungsten, about 0 to 0.1% zirconium, about 0.001% to 0.1% lanthanum and the balance >23% iron with incidental impurities aggregating less than about 0.6%.

20. The alloy of claim 19 having about 0.1 to 0.5% aluminum, about 0.5 to 2% manganese, about 0.001 to 0.1% zirconium and about 0.001 to 0.1% lanthanum.

21. The alloy of claim 19 wherein the aggregate % of carbon plus nitrogen is >0.25.

22. An improved oxidation resistant iron base alloy consisting essentially of about 0.1 to 0.5% aluminum, about 0.05 to 0.16% carbon, less than 0.2% columbium, about 15 to 25% cobalt, about 19 to 23% chromium, about 0.5 to 2.0% manganese, about 0.10 to 0.25% nitrogen, about 15 to 25% nickel, about 0.2 to 0.5% silicon, about 0.4 to 2% tantalum, about 1 to 8% tungsten, about 0.001 to 0.1% zirconium, about 0.001 to 0.1% lanthanum and the balance >23% carbon with incidental impurities aggregating less than about 0.6% and wherein the aggregate % of carbon plus nitrogen is >0.25.

23. The alloy of claim 22 having about 1 to 4% tungsten and columbium >0.1%.

24. The alloy of claim 22 wherein the aggregate columbium and tantalum content is at least 0.4%.

25. The alloy of claim 23 wherein the aggregate columbium and tantalum content is at least 0.4%.

* * * * *

UNITED STATES PATENT AND TRADEMARK OFFICE

CERTIFICATE OF CORRECTION

PATENT NO. : 4,272,289

DATED : June 9, 1981

INVENTOR(S) : ROBERT B.H. HERCHENROEDER and H. JOSEPH KLEIN

It is certified that error appears in the above-identified patent and that said Letters Patent are hereby corrected as shown below:

In TABLE I, across from Alloy N, under column C, "0.1" should read -- 0.11 --.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*